United States Patent [19]

Kidder

[11] 4,005,865

[45] Feb. 1, 1977

[54] THREE-DIMENSIONAL AMUSEMENT DEVICE

[76] Inventor: David Conrad Kidder, Box 902, Pointe Aux Pins, Mich. 49775

[22] Filed: Sept. 29, 1975

[21] Appl. No.: 617,900

[52] U.S. Cl. ..... 273/109; 273/114; 273/153 R

[51] Int. Cl.[2] ..... A63F 9/06

[58] Field of Search ..... 273/109, 114, 153 R; 46/43

[56] References Cited

UNITED STATES PATENTS

| | | | |
|---|---|---|---|
| 479,475 | 7/1892 | Stutz | 273/109 |
| 649,429 | 5/1900 | Brisco | 273/114 |
| 3,069,805 | 12/1962 | Burrows | 273/153 UX |
| 3,079,728 | 3/1963 | Melin | 46/51 X |
| 3,610,624 | 10/1971 | Fleischer | 46/43 X |
| 3,758,981 | 9/1973 | Hlasnicek | 273/109 UX |

*Primary Examiner*—Anton O. Oechsle

*Attorney, Agent, or Firm*—Geoffrey R. Myers

[57] ABSTRACT

Provided is a three-dimensional amusement device comprising a hollow transparent container. Within the container is wrapped, in a multitude of bends and directions, a hollow, transparent tube joined at its ends by a joining plug, thereby forming a continuous, multiplanar three-dimensional passageway network located entirely within the container. The joining plug is marked to indicate start and finish, and forms a carrier in the passageway. Within the passageway is located a small bead of mercury capable of moving as a bead through the continuous passageway from one end of the plug to the other. The object of the amusement is to tilt the container in such a fashion as to work the mercury bead from one end of the plug to the other via the continuous passageway.

5 Claims, 3 Drawing Figures

THREE-DIMENSIONAL AMUSEMENT DEVICE

This invention relates to an amusement device. More particularly, this invention relates to an amusement device of the novelty type, wherein a three-dimensional passageway is provided, the object being to move an indicator from one end of the three-dimensional passageway to the other.

Novelty devices employing mazes, of substantially a two-dimensional type, in which the object is to have a small ball or bead run the maze from one end to the other via gravity by tilting of the device, are well known in the industry. In addition, mazes employing three-dimensional tunnels and tubes are known. Exemplary of such known devices are found in the following U.S. Pat. Nos.:

507,667
1,314,898
1,965,083
2,318,793
2,509,340
3,069,805
3,109,651
3,758,981

It is the purpose of this invention to provide a three-dimensional novelty item or device which provides pleasure and challenge to the user. In many instances, and because of the differences over the known prior art devices, the invention provides additional challenge, has increased flexibility in its end use by varying its size and other factors, has an esthetic or decorative value, and has other values apparent to the skilled artisan once given the following disclosure, within which:

IN THE DRAWINGS

Generally speaking, the devices of this invention comprise a container having therein a hollow and transparent tube, the tube being provided with a plurality of bends in different planar directions to form a three-dimensional passageway network, an indicator means within the passageway capable of moving freely through the passageway by force of gravity, and a barrier means located within the passageway, past which the indicator means cannot move, the container being sufficiently transparent to allow viewing of the indicator means in any location within the passageway.

In certain preferred embodiments of this invention, the tube forming the passageway is joined at its ends, which in other preferred embodiments of this invention is by way of a plug or dowel which optionally may be provided with markings for designating "start" and "end" positions in the device. In certain preferred embodiments of this invention, the container is a rectangular-shaped device bearing six transparent sides, usually a cube. The tube is, preferably, a transparent plastic, and is wound completely within the container, so as to form a closed system. In other preferred embodiments, the indicator means may be a bead of cohesive material, such as a plastic colored bead or a drop of mercury, in each instance the bead being capable of moving freely from one end of the barrier to the other through the tube by force of gravity, usually through tilting of the device.

Figure 1:
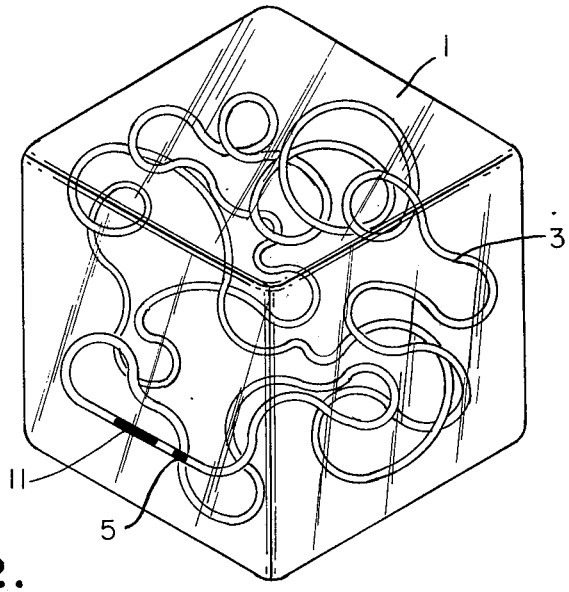
FIG. 1 is a three-dimensional view of one embodiment of the subject invention.
Figure 2:
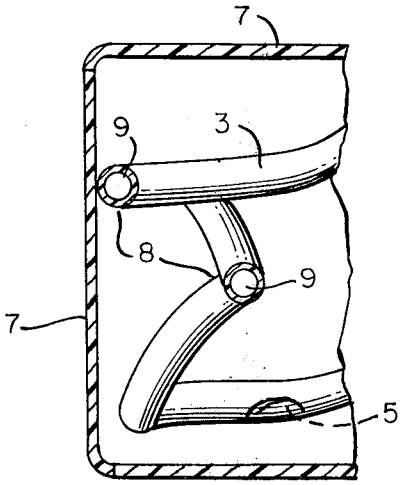
FIG. 2 is a partially sectionalized view of the embodiment of FIG. 1.
Figure 3:
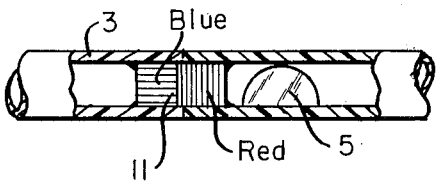
FIG. 3 is a partially sectionalized view of a tube joinder plug, tube and indicator means in accordance with an embodiment of this invention.

With reference now to the specific embodiments illustrated in FIGS. 1–3, it can be seen that there is provided a transparent rectangular (in this instance, cubic) container 1, having completely enclosed therewithin a hollow plastic transparent tube 3. Tube 3 is randomly wound through so as to be provided with a plurality of bends formed in different planar directions, thereby to form a three-dimensional passageway network through which indicator bead 5 may be moved. In winding plastic tube 3, bends must not be made so acute as to restrict the passageway. Rather the passageway network should be sufficiently large even at the bends to allow bead 5 to move smoothly therethrough by the force of gravity as container 1 is tilted in the desired direction. This is illustrated in FIG. 2, wherein a plurality of bends 8 in tube 3 are shown in cross-section to provide passageway 9 at said bends sufficiently large to allow unrestricted flow of indicator 5 therearound. FIG. 2 further illustrates container 1 as being formed of transparent, relatively thin walls 7 joined together to form a hollow plastic box.

As best illustrated in FIG. 3, tube 1 may be joined at its ends by a dowel or plug means 11 inserted within the hollow orifice of either end of tube 3. Dowel 11 may be indicated, such as illustrated in FIG. 3, by making one end red and the other end blue, thereby indicating "start" and "end" positions for indicator bead 5. Other mechanisms for joining the ends of tube 3 may, of course, also be used, such as, for example, a transparent sleeve around the outside of tube 3 at the connecting ends. In addition, dowel 11 or other barrier means does not have to be located at the ends of joinder of the tubes. For example, dowel 11 or other barrier may be employed at any location within tube 3. In this instance, however, care should be taken so that joinder of the ends of tube 3 does not restrict the passageway, thereby allowing indicator bead 5 to move freely therepast.

In operation, the device provides a unique challenge for the dexterity of the user. The three-dimensional passageway network formed by the plurality of bends in different planar directions of tube 3 may be formed in varying degrees of complexity. This network must be negotiated by bead 5 by tilting in a multitude of directions, container 1. The device may be made simple, by reducing the number of bends, or may be made extremely complex by increasing the number of bends, and the amount of different planar directions in which these bends go.

A complex system might be one where a multitude of knots are formed in the tube or the tube is heavily cramped within the container. A typical example of a relatively complex system might be where a five-inch cubic container of one-eighth inch clear acrylic plastic walls, contained approximately 16 feet of flexible plastic tubing, having a one-eighth inch inside diameter. These dimensions are not critical, since the cube can be made very small so that a small child could tilt it with one hand, or it could be made large enough so that it takes several people to tilt it, such as where the cube may be several feet high and wide, and comprise one hundred or more feet of plastic tubing of relatively large diameter. In such an instance, a group of people might operate it over a large field or on a beach, as a game.

As can be seen from the above embodiment, the subject invention provides a unique range of possibilities and uses for the device. Being a closed system, the device not only has unique aspects related to challenging dexterity, but also can serve, given the appropriate weight and size, as an esthetic decorative device as well.

Once given the above disclosure, many of the features, modifications and improvements will become apparent to the skilled artisan. Such other features, modifications and improvements are, therefore, considered to be a part of this invention, the scope of which is to be determined by the following claims.

I claim:

1. A device comprising a container having therein a hollow and transparent tube, said tube being joined at its ends and provided with a plurality of bends in different planar directions to form a three-dimensional passageway network, an indicator means within said passageway capable of moving freely through said passageway by force of gravity, and a barrier means located within said passageway past which said indicator means cannot move and being indicatively marked to signify start and finish, said container being sufficiently transparent to allow viewing of said indicator means in any location within said passageway.

2. A device according to claim 1 wherein said indicator means is a bead of cohesive material.

3. A device according to claim 2 wherein said bead is of mercury.

4. A device according to claim 1 wherein said container is of transparent plastic and said hollow tube is a transparent plastic tube joined at its ends by a joining plug which also serves as said barrier means.

5. A device according to claim 1 wherein said container is a hollow rectangle having six transparent sides.

* * * * *